US008398063B2

(12) United States Patent
Ebert et al.

(10) Patent No.: US 8,398,063 B2
(45) Date of Patent: Mar. 19, 2013

(54) RIBBON TRANSPORT APPARATUS AND METHOD

(75) Inventors: Dieter Theodor Ebert, Stratham, NH (US); Barry Mark Jackson, York, ME (US); Dave John Gagnon, Somersworth, NH (US)

(73) Assignee: Gross International Americas, Inc., Durham, NH (US)

( * ) Notice: Subject to any disclaimer, the term of this patent is extended or adjusted under 35 U.S.C. 154(b) by 0 days.

(21) Appl. No.: 12/316,137

(22) Filed: Dec. 10, 2008

(65) Prior Publication Data

US 2010/0140311 A1 Jun. 10, 2010

(51) Int. Cl.
*B41L 43/04* (2006.01)
*B65H 20/10* (2006.01)

(52) U.S. Cl. ..... 270/41; 226/95; 226/170

(58) Field of Classification Search ..... 226/93, 226/95, 170; 270/41, 42; 493/81, 201; 101/174, 101/181

See application file for complete search history.

(56) References Cited

U.S. PATENT DOCUMENTS

| | | | | |
|---|---|---|---|---|
| 419,644 | A * | 1/1890 | Crowell | 270/41 |
| 3,115,315 | A * | 12/1963 | Dunlap, Jr. et al. | 242/594 |
| 3,649,001 | A * | 3/1972 | Schieven | 270/52.1 |
| 3,964,235 | A * | 6/1976 | Miller et al. | 53/118 |
| 4,279,409 | A * | 7/1981 | Pemberton | 270/5.02 |
| 4,336,813 | A | 6/1982 | Seragnoli | 131/84 |
| 4,495,746 | A * | 1/1985 | Focke et al. | 53/389.3 |
| 4,660,752 | A * | 4/1987 | Rikard et al. | 226/95 |
| 4,716,909 | A * | 1/1988 | Belvederi et al. | 131/84.1 |
| 5,176,305 | A * | 1/1993 | Baarfusser et al. | 226/95 |
| 5,685,528 | A | 11/1997 | Weis | 270/6 |
| 5,706,994 | A * | 1/1998 | Welch et al. | 226/95 |
| 5,762,253 | A * | 6/1998 | Åberg et al. | 226/95 |
| 5,904,312 | A * | 5/1999 | Hinz et al. | 242/525 |
| 6,405,914 | B1 * | 6/2002 | Broom et al. | 226/95 |
| 6,419,217 | B1 | 7/2002 | Hartmann | 270/52.12 |
| 6,425,512 | B2 * | 7/2002 | Hill et al. | 226/7 |
| 6,544,160 | B1 | 4/2003 | Hartmann et al. | |
| 6,630,057 | B2 * | 10/2003 | Broom et al. | 162/363 |
| 6,648,198 | B2 * | 11/2003 | Demers | 226/95 |
| 7,625,465 | B2 * | 12/2009 | Pesch et al. | 162/367 |
| 7,681,327 | B2 * | 3/2010 | Koljonen et al. | 34/117 |

(Continued)

FOREIGN PATENT DOCUMENTS

| | | | |
|---|---|---|---|
| DE | 40 40 830 | A1 | 7/1992 |
| EP | 1401749 | B1 | 11/2005 |

(Continued)

OTHER PUBLICATIONS

Extended European Search Report of corresponding application EP 09832558.2.

*Primary Examiner* — Michael Mansen
*Assistant Examiner* — Scott Haugland
(74) *Attorney, Agent, or Firm* — Davidson, Davidson & Kappel, LLC

(57) ABSTRACT

A ribbon transport apparatus for a printing press is provided. The ribbon transport apparatus includes a vacuum conveyor belt transporting a ribbon and a manifold supporting the vacuum conveyor belt. The vacuum conveyor belt and the manifold are arranged to draw the ribbon towards the vacuum conveyor belt via a suction. A method of transporting a ribbon in a printing press is also provided.

21 Claims, 4 Drawing Sheets

U.S. PATENT DOCUMENTS

2001/0050154 A1* 12/2001 Broom et al. ..... 162/193
2002/0074377 A1* 6/2002 Broom et al. ..... 226/95
2003/0089756 A1 5/2003 Demers
2007/0119895 A1* 5/2007 Pesch et al. ..... 226/95
2007/0184959 A1 8/2007 Beck et al.
2009/0101687 A1* 4/2009 Raueiser ..... 226/95
2010/0140311 A1* 6/2010 Ebert et al. ..... 226/1

FOREIGN PATENT DOCUMENTS

WO WO 02/102697 A1 12/2002

* cited by examiner

RIBBON TRANSPORT APPARATUS AND METHOD

The present invention relates generally to printing presses, and more particularly to web printing presses with web guiding apparatuses.

BACKGROUND OF THE INVENTION

In the web offset printing process, a continuous web of paper is transported through a printing press. Near the beginning of the press, one or more printing units may apply ink to the web to repeatedly create a pattern, or impression, of text and images. At the end of the press, a web conversion machine, such as a folder, may be used to cut and fold the web into signatures.

To convert a web into signatures, the web may be slit into ribbons, and the ribbons may be redirected by lead rolls and angle bars into a stacked configuration for subsequent folding and cutting. Ribbons may be transported with each edge being an equal distance above the floor or with the ribbons traveling on-edge so that one edge is above the other. With on-edge ribbon transport, it can be more difficult to install the ribbons in the machine, and the ribbons may be more likely to fall to the floor when they break.

SUMMARY OF THE INVENTION

A ribbon transport apparatus for a printing press is provided. The ribbon transport apparatus includes a vacuum conveyor belt transporting a ribbon and a manifold supporting the vacuum conveyor belt. The vacuum conveyor belt and the manifold are arranged to draw the ribbon towards the vacuum conveyor belt via a suction.

A method of transporting a ribbon in a printing press is also provided. The method includes the steps of pulling air through holes of a vacuum conveyor belt to draw a ribbon to a surface of the vacuum conveyor belt and translating the vacuum conveyor belt to transport the ribbon.

BRIEF DESCRIPTION OF THE DRAWINGS

The present invention is described below by reference to the following drawings, in which.

DETAILED DESCRIPTION

Figure 1:
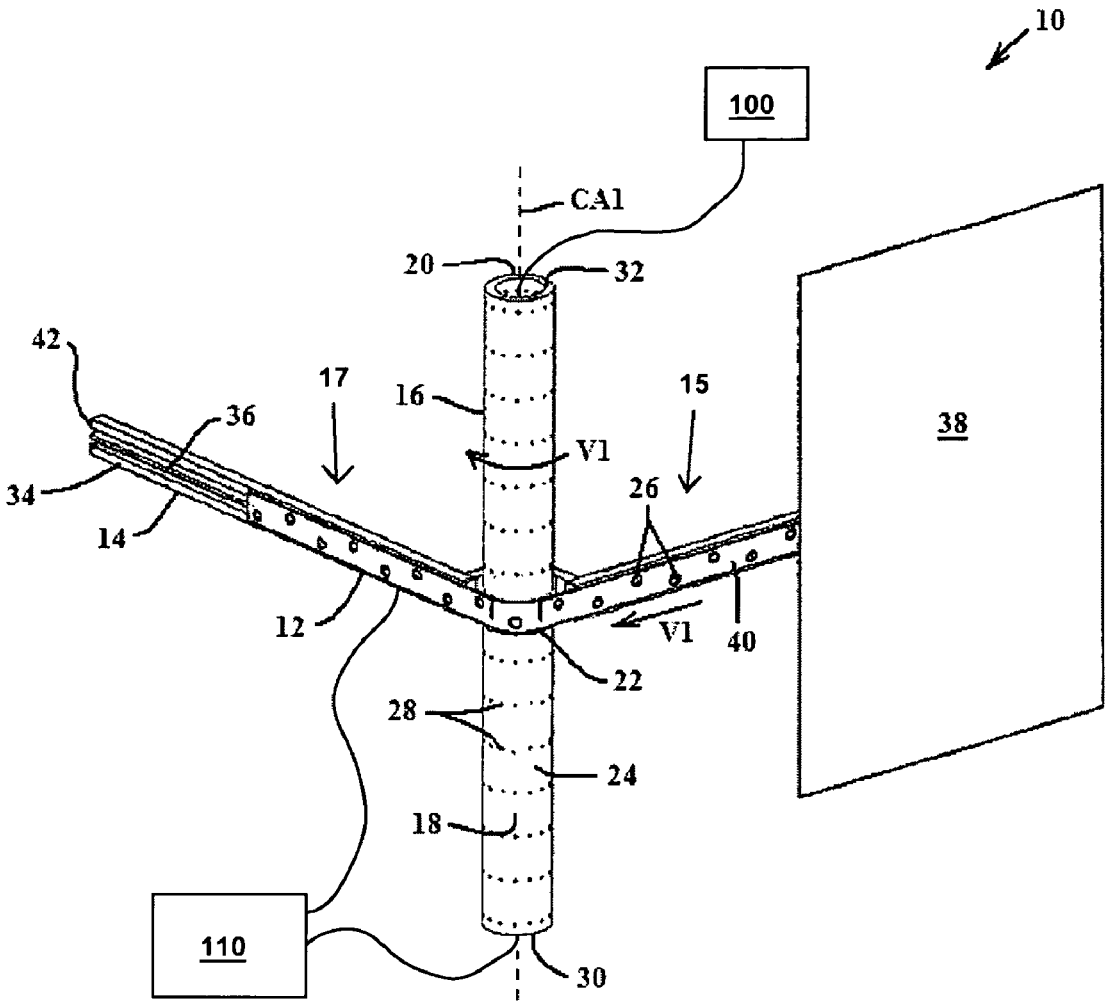
FIG. 1 schematically shows a perspective view of a ribbon guiding section of a ribbon transport apparatus according to an embodiment of the present invention.

FIG. 1 schematically shows a perspective view of a ribbon guiding section 10 of a ribbon transport apparatus according to an embodiment of the present invention. Ribbon guiding section 10 includes a vacuum conveyor belt 12, a vacuum chamber manifold 14, and a lead roll 16. In this embodiment, a center axis CA1 is aligned in the vertical direction and an outer surface 40 of vacuum conveyor belt 12 is aligned in the vertical direction, such that ribbon guiding section 10 may act to direct a ribbon 38, while maintaining the vertical orientation of ribbon 38, with one edge of ribbon 38 over the other, during a break or tear in ribbon 38.

Ribbon 38 may include a plurality of ribbons. Manifold 14 and lead roll 16 form a path for vacuum conveyor belt 12 to travel. Vacuum conveyor belt 12 is supported on lead roll 16 by an undercut 22 in lead roll 16, which acts to control the orientation of vacuum conveyor belt 12. Undercut 22 is machined into lead roll 16 in a manner such that undercut 22 extends radially into lead roll 16 a depth that is equal to or greater than a thickness of conveyor belt 12. Undercut 22 is continuous throughout a circumference of lead roll 16. Manifold 14 supports vacuum conveyor belt 12 as vacuum conveyor belt 12 travels towards and away from lead roll 16, and is arranged to allow vacuum conveyor belt 12 to wrap around a front side 18 of lead roll 16 in undercut 22. A portion 15 of manifold 14 that is upstream of lead roll 16 is angled in relation to a portion 17 of manifold 14 that is downstream of lead roll 16. Manifold 14 is a continuous body and between portions 15, 17, manifold 14 wraps around a back side 20 of lead roll 16 and ceases to contact vacuum conveyor belt 12 as vacuum conveyor belt 12 contacts undercut 22 of lead roll 16.

Figure 2:
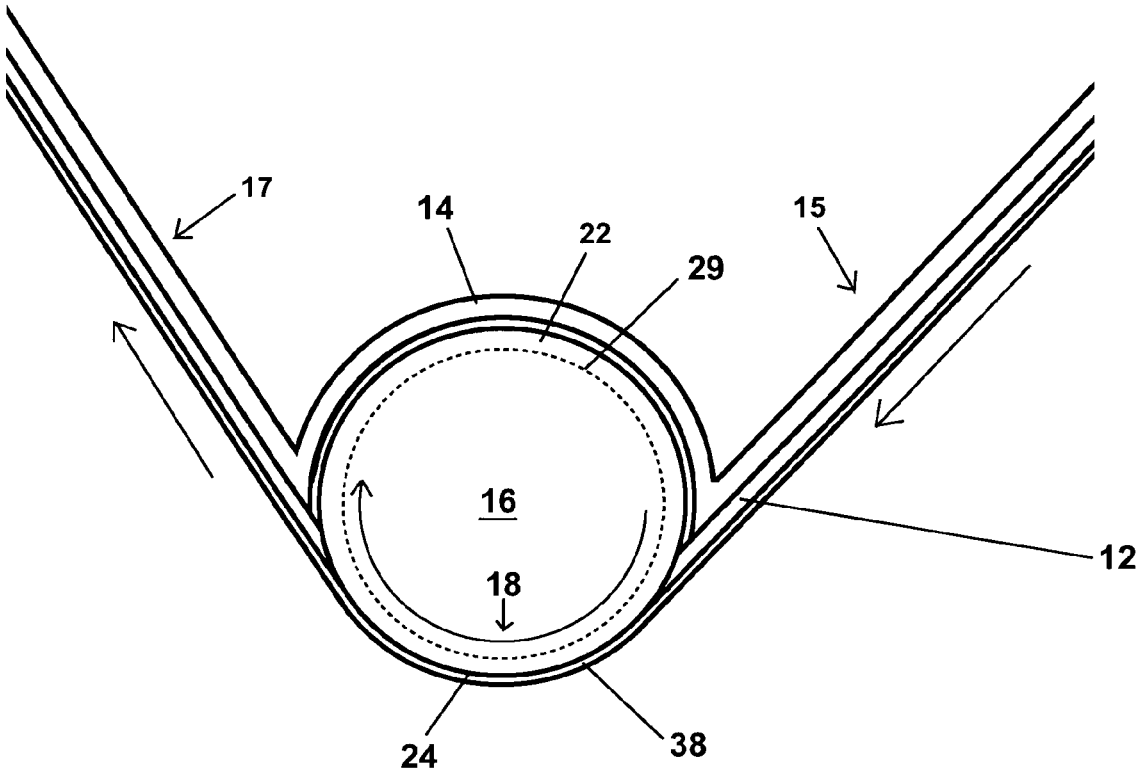
FIG. 2 schematically shows a plan view of the ribbon guiding section shown in FIG. 1.

Vacuum conveyor belt 12 is shown as being discontinuous in order to show manifold 14 in better detail, but is a continuous belt traveling in a continuous loop. A continuous view of conveyor belt 12 traveling in a loop is shown in FIG. 2. Vacuum conveyor belt 12 and lead roll 16 are perforated with holes 26 and 28, respectively. In order to draw ribbon 38 to the surface of vacuum conveyor belt 12 and to outer surface 24 of front side 18 of lead roll 16, a pump 110 draws air into manifold 14 through holes 26 and into lead roll 16 through holes 28. Lead roll 16 may be sealed at a bottom edge 30 and a top edge 32. A sealing contact is formed between manifold 14 and conveyor belt 12 along an edge 34. A center support 36 in manifold 14 prevents vacuum conveyor belt 12 from being drawn into manifold 14.

During operation of ribbon guiding section 10, a motor 100 rotates lead roll 16 about center axis CA1 at a surface velocity V1 and vacuum conveyor belt 12 slides along manifold 14 and in undercut 22 of lead roll 16 at velocity V1. Vacuum conveyor belt 12 and lead roll 16 are used to transport ribbon 38 along the path of vacuum conveyor belt 12 at velocity V1. When ribbon 38 is placed against outer surface 40 of vacuum conveyor belt 12, ribbon 38 adheres to vacuum conveyor belt 12 due to the lower pressure inside manifold 14. Ribbon 38 is carried by vacuum conveyor belt 12 to lead roll 16 where ribbon 38 adheres to outer surface 24 due to lower pressure inside lead roll 16. Rotation of lead roll 16 causes ribbon 38 to wrap around front side 18 of lead roll 16. Vacuum conveyor belt 12, following a path of second portion 17 of manifold 14, ensures that vacuum conveyor belt 12 does not wrap further around lead roll 16 to back side 20, and transport ribbon 38 away from lead roll 16.

Although FIG. 1 shows vacuum conveyor belt 12 positioned in the middle of lead roll 16, vacuum conveyor belt 12 may be positioned anywhere between bottom edge 30 and top edge 32 of lead roll 16. Additionally, the height of vacuum conveyor belt 12 may be varied as necessary to maximize support and transport of ribbon 38.

FIG. 2 shows a plan view of ribbon guiding section 10 shown in FIG. 1. Vacuum conveyor belt 12 transports ribbon 38 past lead roll 16. Lead roll 16 includes undercut 22, which is defined by an inner circumference 29. A path of vacuum conveyor belt 22 is defined by manifold 14 and front side 18 of lead roll 16. Manifold 14 is arranged such that portion 15 of manifold 22 supports vacuum conveyor belt 12 as vacuum conveyor belt 12 travels towards lead roll 16 and portion 17 of manifold 22 supports vacuum conveyor belt 12 as vacuum conveyor belt 12 travels away from lead roll 16. Undercut 22 in lead roll 16 supports vacuum conveyor belt 12 as vacuum conveyor belt 12 passes lead roll 16. As vacuum conveyor belt 12 transports ribbon 38 past lead roll 16, ribbon 38 adheres to outer surface 24 of lead roll 16. Vacuum conveyor belt 12, along with manifold 14, separates ribbon 38 from lead roll 16 at point 39, where vacuum conveyor belt 12 comes out of contact with undercut 22. Friction between vacuum conveyor belt 12 and a surface of inner circumference 29 of undercut 22 allows lead roll 16 to help transport vacuum conveyor 12 as lead roll is rotated.

Figure 3:
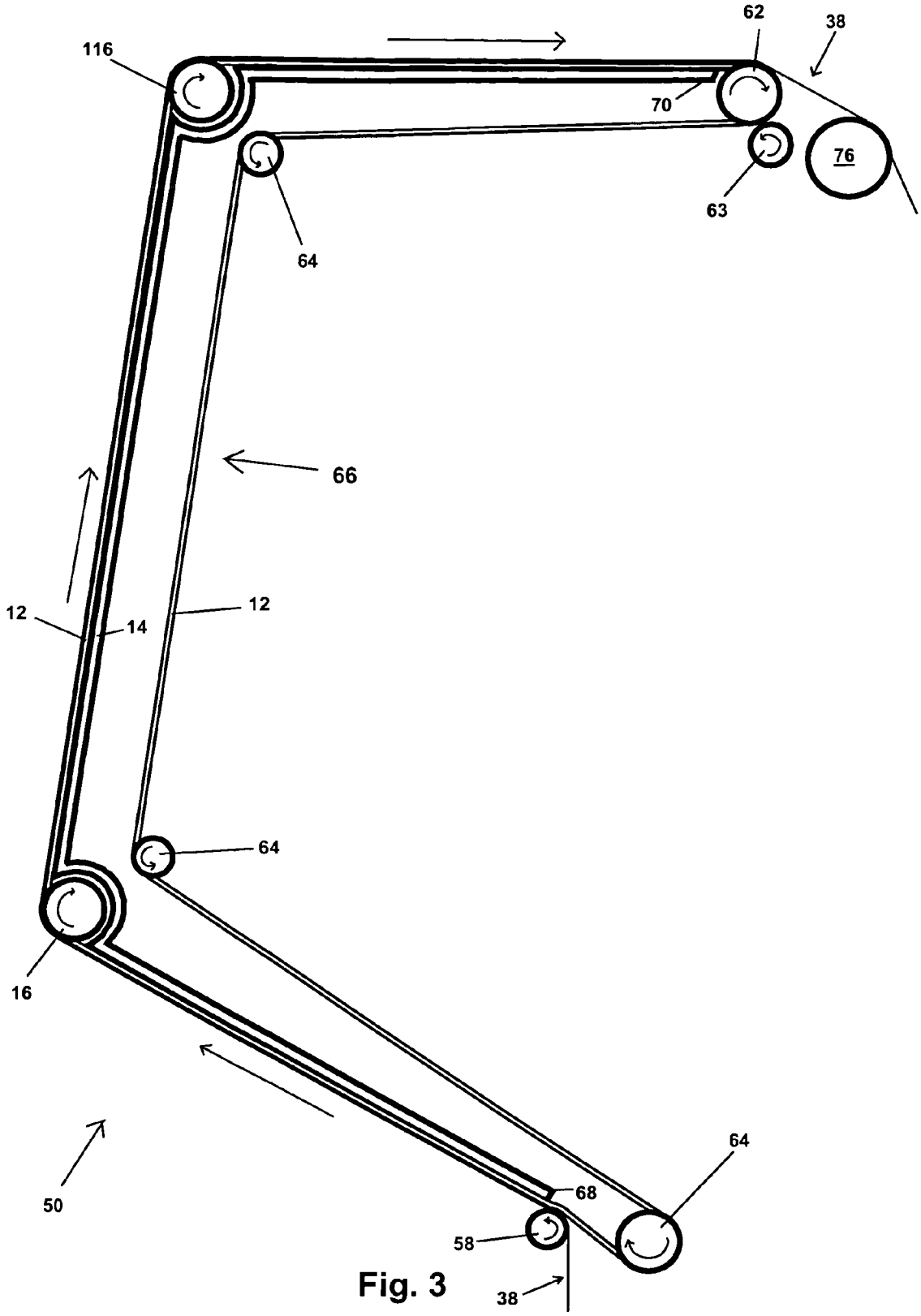
FIG. 3 schematically shows a plan view of a ribbon transport apparatus according to an embodiment of the present invention.

FIG. 3 schematically shows a plan view of a ribbon transport loop 50 according to an embodiment of the present invention. Vacuum conveyor belt 12 is wrapped around lead rolls 16, 116, a pull roll 62 and return rolls 64 in a continuous loop. Lead rolls 16, 116 and pull roll 62 have undercuts to prevent vacuum conveyor belt 52 from protruding beyond outer surfaces of lead rolls 16, 116 and pull roll 62. Return rolls 64 may also be undercut to prevent vertical slipping of vacuum conveyor belt 12.

Ribbon 38 enters ribbon transport loop 50 near a first end 68 of manifold 14. An idle roller 58 helps guide ribbon 38 as ribbon 38 comes into contact with vacuum conveyor belt 12, which is being continuously translated about lead rolls 16, 116, return roll 64 and pull roll 62. Vacuum conveyor belt 12, forming a suction with manifold 14, transports ribbon 38 to lead roll 16. As vacuum conveyor belt 12 passes lead roll 16, vacuum conveyor belt 12 comes out of contact with manifold 14 and passes through undercut 22 (see FIG. 1) in lead roll 16. Ribbon 38 is drawn to the surface of lead roll 16 and is transported by lead roll 16 as lead roll 16 rotates. As vacuum conveyor belt 12 exits undercut 22 (see FIG. 1) of lead roll 16 ribbon 38 is drawn away from lead roll 16 and vacuum conveyor belt 12 comes back into contact with manifold 14.

Vacuum conveyor belt 12, following a path of manifold 14, transports ribbon 38 from lead roll 16 to lead roll 116. Manifold 14 comes out of contact with vacuum conveyor belt 12 as vacuum conveyor belt approaches lead roll 116. Lead roll 116 is configured similar to lead roll 16 and transports ribbon 38 in the same manner as lead roll 16. Lead roll 116 includes an undercut similar to undercut 22 (see FIG. 1) and interacts with vacuum conveyor belt 12 in the same manner as lead roll 16. After vacuum conveyor belt 12 comes out of contact with undercut 22, vacuum conveyor belt 12 is guided by manifold 14 again unit a second end 70 of manifold 14. Vacuum conveyor belt 12 transports ribbon 38 past end 70 to pull roll 62. Ribbon 38 is pulled away from ribbon transport apparatus 50 at pull roll 62 by an RTF 76, a former roller or roll which transports ribbon 38 to a former for longitudinal folding.

During operation of ribbon transport loop 50, a motor rotates pull roll 62 about a center axis CA2 at a velocity V2, causing vacuum conveyor belt 12 to travel around the loop at velocity V2. When a ribbon 38 is placed against vacuum conveyor belt 52 at first end 68, ribbon 38 adheres to vacuum conveyor belt 52 due to lower pressure inside manifold 54.

The center axes of idler roll 58, lead rolls 16, 116 and pull roll 62 may be aligned vertically or horizontally. Vacuum conveyor belt 52 may thus transport ribbon 38 on-edge, as shown in FIG. 3, so that one edge of ribbon 38 is above the other edge, or not on-edge, so that both edges of ribbon 38 are approximately the same distance above the floor.

Unlike web-up chains requiring a cross member to be positioned and attached to the lead edge of ribbon 38, vacuum conveyor belt 12 does not require the use of a cross member. Ribbon 38 may be attached to vacuum conveyor belt 12 anywhere along loop 66 between first end 68 and second end 70.

Vacuum conveyor belt 12 may also be used to transport ribbon 38 after initial installation of ribbon 38. When a web break or ribbon break occurs, vacuum conveyor belt 12 may continue to hold and carry ribbon 38, thereby preventing ribbon 38 from falling to the floor. Vacuum conveyor belt 12 thus may advantageously facilitate recovery from web breaks or ribbon breaks. When a web break or ribbon break occurs, vacuum conveyor belt 12 may continue to hold and carry ribbon 38, thereby preventing ribbon 38 from falling out of place and preventing ribbon weave. Vacuum conveyor belt 12 thus may advantageously facilitate recovery from web breaks or ribbon breaks.

Vacuum conveyor belt 12 and manifold 14 could extend beyond pull roll 62 and be used to carry ribbon 38 away from RTF 76 in the event of a web or ribbon break. The broken ribbon could be collected on a spool and later discarded or reused.

Although FIG. 3 shows only ribbon 38 and one ribbon transport loop 50, additional loops may be employed to transport additional ribbons. Multiple vacuum conveyor belts may make it easier to install multiple ribbons because access to the ribbons can be limited, particularly when the ribbons are transported on-edge. By facilitating ribbon installation, ribbon paths may thus advantageously be placed closer together, saving valuable space.

Figure 4:
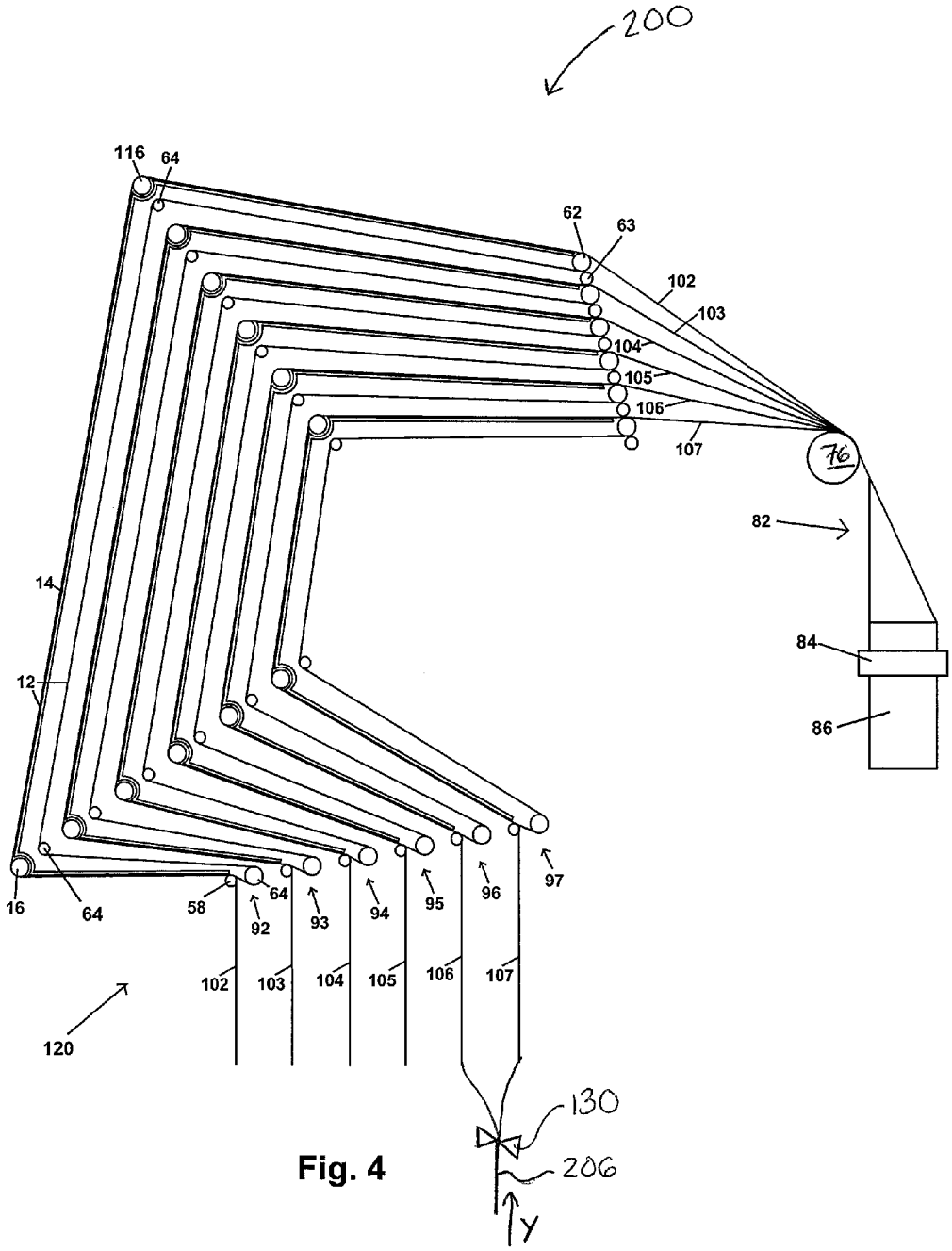
FIG. 4 schematically shows a plan view of a ribbon transport apparatus according to another embodiment of the present invention transporting ribbons to a former.

FIG. 4 schematically shows a plan view of folder 200 including a ribbon transport apparatus 120 according to another embodiment of the present invention transporting multiple ribbons 102, 103, 104, 105, 106, 107 to a former 82. Ribbons 106, 107 were cut by a slitter 130 from a web 206 traveling along a path Y. Each ribbon 102, 103, 104, 105, 106, 107 is transported by a respective ribbon transport loop 92, 93, 94, 95, 96, 97. Each ribbon transport loop 92, 93, 94, 95, 96, 97 is configured similar to ribbon transport loop 50 shown in FIG. 3. Each ribbon transport loop 92, 93, 94, 95, 96, 97 may include lead rolls 16, 116, return rolls 64, idler rolls 58, 63, vacuum conveyor belt 12 and manifold 14. Ribbons 102, 103, 104, 105, 106, 107 are drawn together to form a ribbon bundle 86 by RTF 76. Ribbon bundle 86 is longitudinally folded by former 82 and transported away from ribbon transport apparatus 12 by nip rolls 84 for further processing, such as cutting, cross-folding and other finishing operations.

Vacuum conveyor belts could be used to stabilize ribbons during a production run or eliminate the need to tram and level the lead rolls to a fine precision. The vacuum conveyor belt traction would overcome the lateral forces from an out of tram roll. Undercuts in lead rolls 16, 116 and pull rolls 62 could have a small crown to help steer vacuum conveyor belts 12 and ribbons 102, 103, 104, 105, 106, 107.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A folder for a printing press, the folder folding and cutting a plurality of ribbons slit from a web, the folder comprising:

the web traveling along a path, the web being slit by a slitter into the plurality of ribbons;

a ribbon transport apparatus including a vacuum conveyor belt arranged in a vertical alignment on one edge of the vacuum conveyor belt transporting at least one of the plurality of ribbons in a vertical alignment on one edge of the at least one ribbon and a manifold supporting the vacuum conveyor belt, the vacuum conveyor belt and the manifold arranged to draw the at least one ribbon towards the vacuum conveyor belt via a suction;

a former roll for receiving the at least one ribbon downstream of the ribbon transport apparatus; and a former receiving the at least one ribbon from the former roll, the former longitudinally folding the ribbon.

2. The folder as recited in claim 1 wherein the ribbon transport apparatus further includes a lead roll for guiding the vacuum conveyor belt as the vacuum conveyor belt transports the at least one ribbon past the lead roll, the lead roll supporting the at least one ribbon as the at least one ribbon is transported past the lead roll.

3. The folder as recited in claim 2 wherein the lead roll includes an undercut supporting the vacuum conveyor belt on the lead roll.

4. The folder as recited in claim 3 wherein the manifold wraps around a back side of the lead roll and the vacuum conveyor wraps around a front side of the lead roll in the undercut.

5. The folder as recited in claim 4 wherein the lead roll is configured so that a suction created inside of the lead roll draws the at least one ribbon to an outer surface of the lead roll.

6. The folder as recited in claim 2 wherein the ribbon transport apparatus further includes a second lead roll guiding the vacuum conveyor belt downstream from the lead roll, the lead roll and the second lead roll including holes in outer surfaces thereof, a suction being created in the lead roll and the second lead to adhere the at least one ribbon to the outer surfaces thereof.

7. The folder as recited in claim 6 wherein the manifold extends from upstream of the lead roll to downstream of the second lead roll such that a first portion of the manifold is upstream of the lead roll, a second portion of the manifold is downstream of the lead roll and upstream of the second lead roll and a third portion of the manifold is downstream of the second lead roll.

8. The folder as recited in claim 7 wherein the second portion of the manifold is angled with respect to the first portion of the manifold along a path of the at least one ribbon and the third portion of the manifold is angled with respect to the second portion of the manifold along the path of the at least one ribbon such that the vacuum conveyor belt transports the at least one ribbon in three different directions.

9. The folder as recited in claim 6 wherein the ribbon transport apparatus further includes a pull roll downstream of the second lead roll, the vacuum conveyor belt forming a continuous loop around the lead roll, the second lead roll and the pull roll such that the vacuum conveyor belt transports the at least one ribbon in the vertical alignment on one edge from upstream of the lead roll to the former roll.

10. The folder as recited in claim 1 wherein the ribbon transport apparatus further includes a pump drawing air into the manifold to create the suction.

11. The folder as recited in claim 10 wherein the conveyor belt includes holes that the pump draws air through.

12. The folder as recited in claim 1 wherein the ribbon transport apparatus further includes a plurality of rolls transporting the vacuum conveyor belt, the vacuum conveyor belt forming a continuous loop and being wrapped around the rollers.

13. The folder as recited in claim 12 wherein the ribbon transport apparatus further includes return rolls outside of the continuous loop guiding the vacuum conveyor belt.

14. The folder as recited in claim 12 wherein the ribbon transport apparatus further includes:

a second vacuum conveyor belt transporting a second ribbon, the second ribbon being from the plurality of ribbons;

a second manifold supporting the second conveyor belt;

a plurality of second rolls transporting the second vacuum conveyor belt; and the former roll draws together the at least one ribbon and the second ribbon to form a ribbon bundle.

15. The folder as recited in claim 14 wherein the former receives the ribbon bundle from the former roll and longitudinally folds the ribbon bundle.

16. The folder as recited in claim 1 wherein an outer surface of the conveyor is aligned in a vertical direction.

17. A method of forming and transporting at least one of a plurality of ribbons in a printing press comprising the steps of:

slitting a web into the plurality of ribbons;

pulling air through holes of a vacuum conveyor belt to draw the at least one of the plurality of ribbons to a surface of the vacuum conveyor belt;

translating the vacuum conveyor belt arranged in a vertical alignment on one edge of the vacuum conveyor belt to transport the at least one ribbon in a vertical alignment on one edge of the at least one ribbon;

gathering the at least one ribbon from the vacuum conveyor at a former roll; and folding the at least one ribbon with a former.

18. The method as recited in claim 17 wherein the vacuum conveyor belt is translated by a lead roll, the vacuum conveyor belt being oriented in an undercut of the lead roll.

19. The method as recited in claim 17 further comprising the step of guiding the vacuum conveyor belt via a manifold, the manifold and the vacuum conveyor belt being in sealing contact.

20. The method as recited in claim 17 further comprising the step of transporting the at least one ribbon to a former using the former roll.

21. The method as recited in claim 17 further comprising the steps of:

pulling air through holes of a second vacuum conveyor belt to draw a second ribbon to a surface of the second vacuum conveyor belt, the second ribbon being from the plurality of ribbons;

translating the second vacuum conveyor belt to transport the second ribbon; and drawing the at least one ribbon and the second ribbon together to form a ribbon bundle at the former roll.

* * * * *